US009095985B2

(12) United States Patent
Syrjala

(10) Patent No.: US 9,095,985 B2
(45) Date of Patent: Aug. 4, 2015

(54) VERSATILE KNIFE WITH REMOVABLE BLADE

(76) Inventor: Jerry Syrjala, Belle Plain, MN (US)

( * ) Notice: Subject to any disclaimer, the term of this patent is extended or adjusted under 35 U.S.C. 154(b) by 411 days.

(21) Appl. No.: 13/016,557

(22) Filed: Jan. 28, 2011

(65) Prior Publication Data

US 2012/0192434 A1 Aug. 2, 2012

(51) Int. Cl.

| | |
|---|---|
| ***B26B 1/08*** | (2006.01) |
| ***B26B 1/10*** | (2006.01) |
| ***B26B 5/00*** | (2006.01) |
| *B26B 9/00* | (2006.01) |

(52) U.S. Cl.

CPC ... *B26B 1/08* (2013.01); *B26B 1/10* (2013.01); *B26B 5/00* (2013.01); *B26B 9/00* (2013.01)

(58) Field of Classification Search

CPC ..... B26B 29/02; B26B 5/00; B26B 5/001; B26B 3/06; B26B 27/007; B26B 1/08; B26B 1/10; B26B 9/00

USPC ..... 30/298, 340, 342, 335, 337, 339, 329, 30/151, 314

See application file for complete search history.

(56) References Cited

U.S. PATENT DOCUMENTS

| | | | | | |
|---|---|---|---|---|---|
| 472,006 | A | * | 3/1892 | Walker et al. | 30/295 |
| 1,980,087 | A | * | 11/1934 | Rast | 81/489 |
| D137,451 | S | * | 3/1944 | Harstad | D22/118 |
| 2,359,098 | A | * | 9/1944 | Engle | 30/144 |
| 2,906,021 | A | * | 9/1959 | Cromoga | 30/293 |
| 3,748,742 | A | * | 7/1973 | Bigler et al. | 30/294 |
| 3,839,788 | A | | 10/1974 | Addis | |
| 4,170,061 | A | | 10/1979 | Henry | |
| 4,283,854 | A | | 8/1981 | Austin | |
| 4,302,877 | A | * | 12/1981 | Hart et al. | 30/161 |
| 4,546,510 | A | * | 10/1985 | Harrison | 7/145 |
| 4,601,102 | A | | 7/1986 | Phillips | |
| 4,607,432 | A | | 8/1986 | Montgomery | |
| 4,763,416 | A | | 8/1988 | Copeland | |
| 4,802,279 | A | | 2/1989 | Rowe | |
| 5,033,987 | A | | 7/1991 | Bloch | |
| 5,386,635 | A | | 2/1995 | Sheba | |
| D362,485 | S | * | 9/1995 | Hall | D22/118 |
| 5,845,404 | A | | 12/1998 | Jeffcoat | |
| 6,658,743 | B2 | | 12/2003 | Dudley, Jr. et al. | |
| 6,701,621 | B2 | * | 3/2004 | Kain et al. | 30/160 |
| D501,126 | S | | 1/2005 | Addis | |
| 6,857,192 | B1 | * | 2/2005 | Summers et al. | 30/294 |
| 7,003,884 | B2 | | 2/2006 | Perlmutter et al. | |
| 7,082,688 | B2 | | 8/2006 | Votolato | |
| 7,475,480 | B2 | * | 1/2009 | Votolato | 30/2 |
| 7,555,839 | B2 | * | 7/2009 | Koelewyn | 30/160 |
| 8,267,754 | B2 | * | 9/2012 | Jamison | 452/125 |
| 2003/0037444 | A1 | * | 2/2003 | Chunn | 30/337 |
| 2008/0178474 | A1 | | 7/2008 | Spencer et al. | |
| 2009/0223066 | A1 | * | 9/2009 | Votolato | 30/286 |
| 2009/0313832 | A1 | * | 12/2009 | Jamison | 30/123.6 |
| 2010/0146793 | A1 | | 6/2010 | Jamison | |

* cited by examiner

*Primary Examiner* — Laura M Lee
(74) *Attorney, Agent, or Firm* — Dietz Law Office LLC.

(57) ABSTRACT

A knife is described having a handle that at least partially conforms to the palm of a user and includes an arcuate surface opposite the palm portion of the handle that may be utilized by the user to provide additional leverage and force to a blade cutting edge. The handle also includes finger holds formed in the handle between the palm portion and arcuate portions of the handle. An embodiment further includes an interchangeable blade extending out of the handle from the arcuate surface and may also include an actuable blade lock that fixes a portion of an interchangeable blade within the handle.

12 Claims, 6 Drawing Sheets

VERSATILE KNIFE WITH REMOVABLE BLADE

CROSS-REFERENCE TO RELATED APPLICATIONS

Not Applicable

TECHNICAL FIELD

This invention pertains generally to knives and more particularly to knives having replaceable blades. Further, knives constructed in accordance with the present invention are particularly useful to hunters for gutting, skinning, fleshing, or even quartering of an animal.

BACKGROUND

Generally, knives having blades extending from a handle parallel with a longitudinal axis of the handle are known in the art. Other knives have been described that include a uniquely shaped blade extending from the handle. Many of these knives are designed for a particular cutting function. By way of example, a prior knife described in U.S. Pat. Application Publication No. 2010/0146792A1 is particularly well suited for skinning an animal and includes spreading members disposed at the forward most portion of a knife blade to spread apart two portions of an animal hide when skinning an animal. Similarly, U.S. Pat. No. 5,033,987 describes a knife particularly well suited for skinning and cutting animal carcasses.

Other prior devices describe knives that apply cutting forces utilizing the wrist as a pivot point, rather than utilizing the strength of the user's forearm, triceps, biceps and shoulder muscles. For example, U.S. Pat. No. 5,845,404 (at least at col. 10, lines 25-39) describes a knife that utilizes the hand or wrist as the pivot point for the blade, thus requiring a force to be applied on the handle near the wrist. There is a continued need for an ergonomic knife that reduces the force applied near the user's wrist while effectively providing a cutting force to the blade.

SUMMARY

Embodiments according to aspects of the invention include a knife assembly having a handle, a blade, a palm receiving portion of the handle, and a blade receiving portion of the handle, where the blade receiving portion opposes the palm receiving portion and forms a convex surface extending away from the palm receiving portion. The handle includes finger holds extending through the handle. Interchangeable blades extend outwardly from the convex portion of the handle. The user is expected to grip the handle in the palm of the hand and utilize the convex surface of the handle as a pivot point, thereby transferring the force required of the user's arm to the rearward portion of the forearm and shoulder. In another embodiment of the invention the knife assembly further includes a blade lock engaged with the blade and the handle. Without limitation intended, another embodiment of the invention includes a palm receiving portion having a concave surface formed in the palm receiving portion.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The knife assembly of the present invention includes a handle assembly and an interchangeable blade. The handle assembly includes finger holds and is curved to fit in the palm of a user's hand. The handle assembly includes a convex curvature opposing the palm receiving curve and at least a portion of the convex curve may be used as a pivot point or leverage surface as the blade is drawn over a cutting surface. The handle assembly may include a blade lock that actuates between a locked and open position. Alternatively, the blade lock may engage the blade in a fixed position, requiring disassembly of the handle assembly to replace the blade.

A user of the knife assembly will appreciate that the knife assembly of the present invention is particularly useful for gutting, skinning, fleshing, or even quartering of an animal, but is also particularly useful as a utility knife, and is also particularly useful as a trade knife. For example, without limitation intended, a carpet cutting blade of suitable known construction may be inserted in the handle assembly and the convex curve of the handle is particularly well suited to slide along the carpet while pressure is applied to the blade while cutting the carpet.

Figure 1:
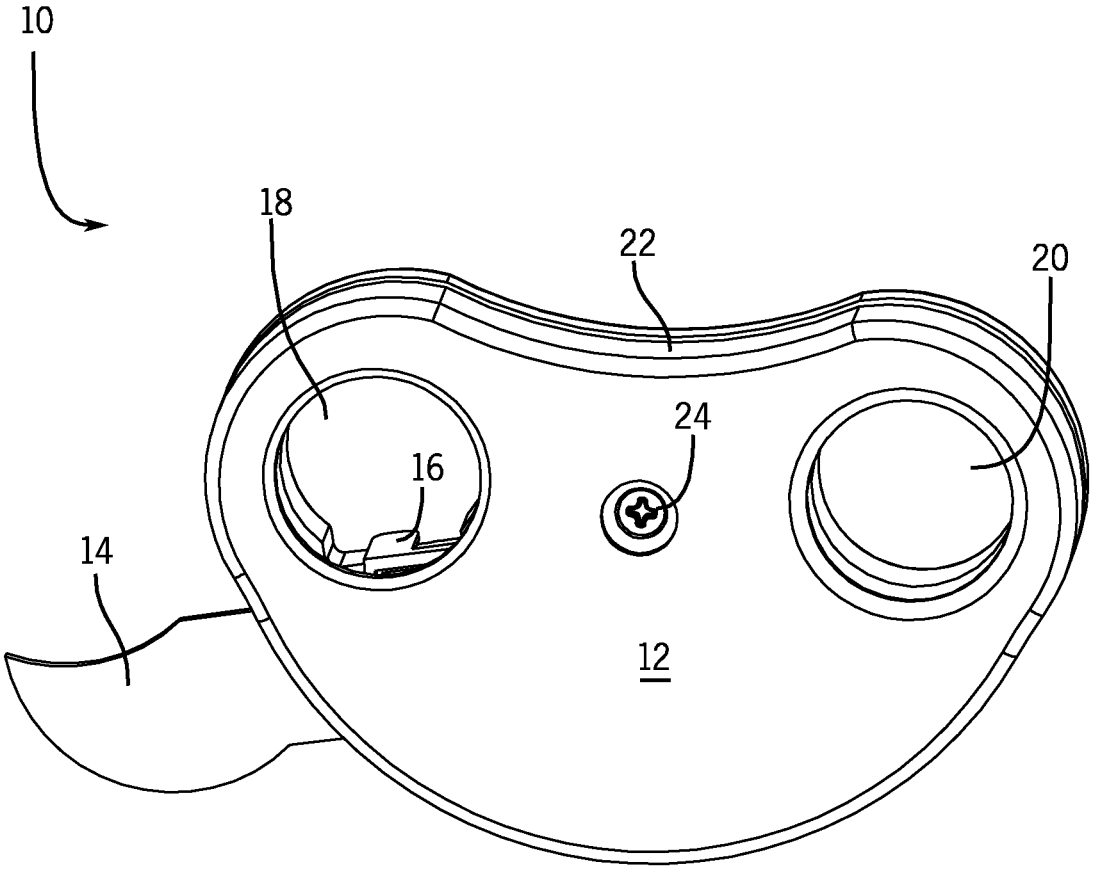
FIG. 1 is a perspective view of the knife assembly in accordance with an embodiment of the invention.
Figure 2:
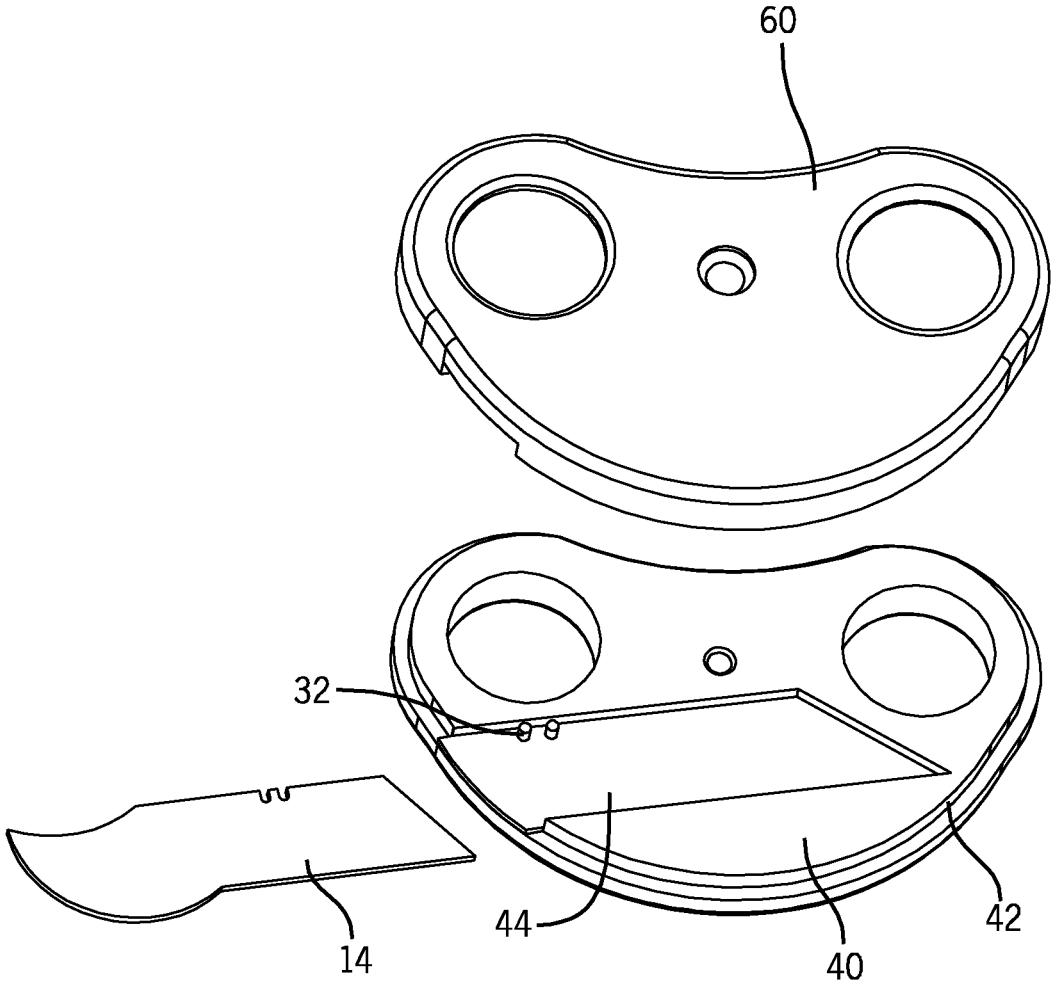
FIG. 2 is a partial exploded perspective view of the knife assembly in accordance with an embodiment of the invention.
Figure 3:
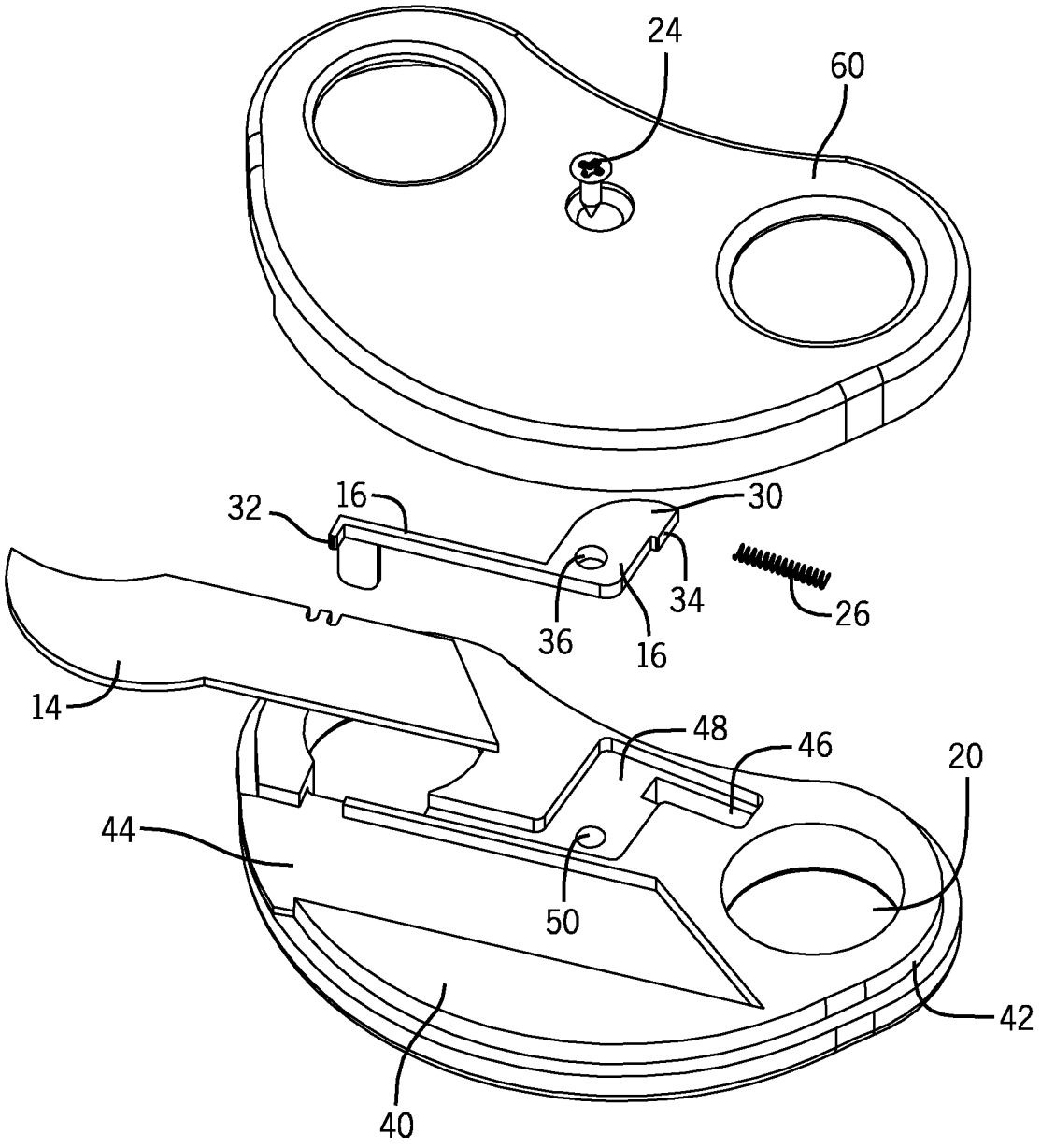
FIG. 3 is a partial exploded perspective view of the knife assembly in accordance with an embodiment of the invention.

Turning attention now to the Figures, embodiments of the knife assembly or versatile knife with removable blade 10 of the present invention will now be described in more detail. The knife assembly 10 is generally shown in FIGS. 1-3 including a handle 12, blade 14, finger holds 18 and 20, and fastener 24. An embodiment of the knife assembly shown in FIGS. 1 and 3 includes a blade lock 16 and actuation spring 26. The embodiment of the knife assembly shown in FIG. 2 includes blade locking pins 32. Lower handle assembly 40 and upper handle assembly may be constructed to engage together with utilizing a configuration of known construction to snap fit the upper and lower assembly together or may be engaged together with a fastener 40. The handle assembly 12 includes a concave curvature 22 configured to fit within the palm of a user's hand. Opposing the curvature 22 is a convex curvature 28 of the handle assembly 12. The blade 14 extends outwardly from the handle 14 adjacent or near a portion of the convex curvature 28. The remaining portion of the convex curvature 28 may be utilized by the user to rest on the cutting surface, guide the blade against the cutting surface, or rotate along the cutting surface in a rocking motion.

Figure 4:
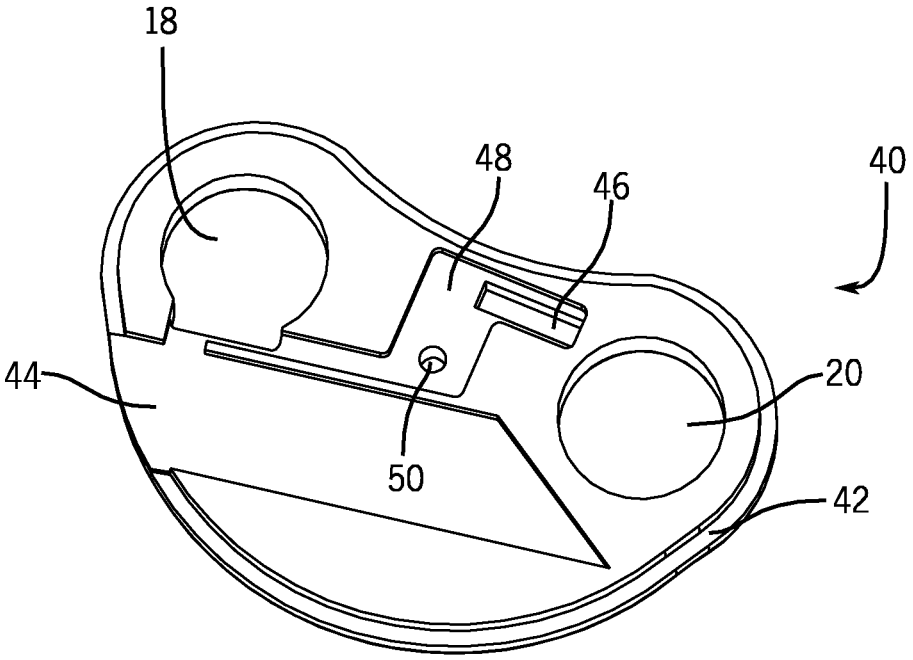
FIG. 4 is a perspective view of the lower handle assembly of the knife assembly in accordance with an embodiment of the invention.

Referring now to FIG. 4, the lower handle assembly 40 is shown including a rim 42, blade pocket 44, spring pocket 46, blade lock pocket 48 and pivot aperture 50. The rim is sized to mate and engage with lip 64 of the upper handle assembly 60. The blade pocket 44 is configured in the shape of a blade 14. The depth of the pocket 44 is only slightly more than the thickness of the blade 14 to reduce the potential movement of the blade in the pocket 44. The spring pocket is adapted to receive a compression spring wherein one end of the spring engages a side of the spring pocket 46 and the other end of the spring 26 engages the spring face 34 of the blade lock 16 (refer also to FIG. 2). The blade lock pocket 48 is configured to receive the shape of the blade lock 16 and is sized to allow sufficient rotation of the blade lock 16 within the blade lock pocket 48 to disengage the blade lock 16 from the blade 14. The pivot aperture is adapted to receive a portion of fastener 24.

Figure 5:
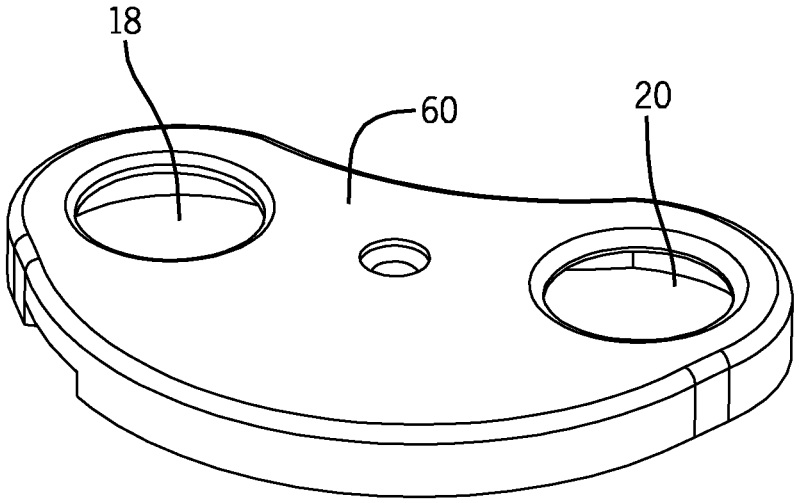
FIG. 5 is a perspective view of the upper handle assembly of the knife assembly in accordance with an embodiment of the invention.
Figure 6:
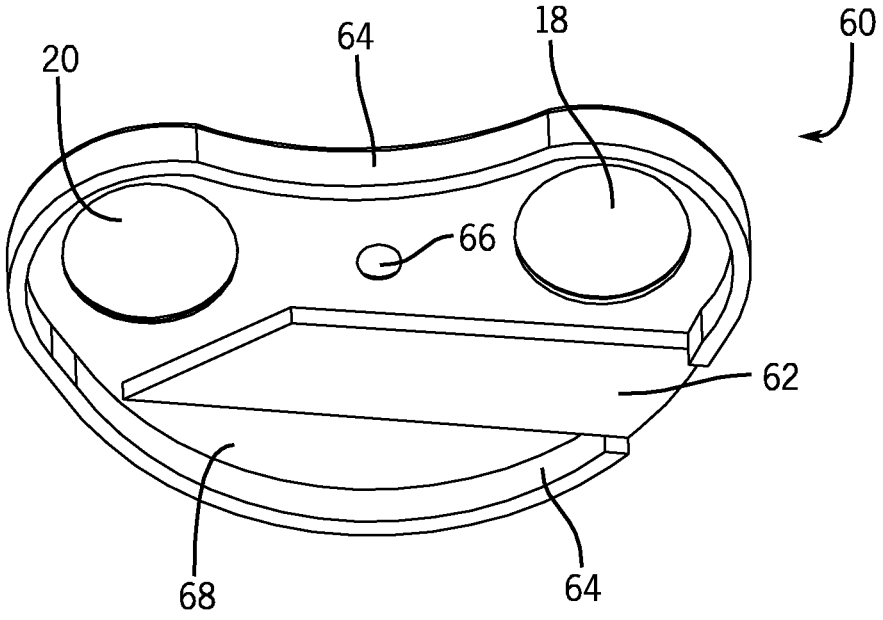
FIG. 6 is a perspective view of the underside of the upper handle assembly of the knife assembly in accordance with an embodiment of the invention.

Referring to FIGS. 5 and 6, the upper handle assembly 60 includes a blade support 62, lip 64, pivot aperture 66 and inner cavity 68. The lip 64 engages around the rim 42 and inner cavity 68 is configured to engage with the top planar surface of the lower handle assembly 40. When the upper handle assembly is engaged with the lower handle assembly, the blade support 62 provides a slight friction fit against blade 14. In this manner the blade 14 may be slid from the handle assembly, but the blade support 62 further restricts rotation of the blade within the blade pocket 44.

Figure 7:
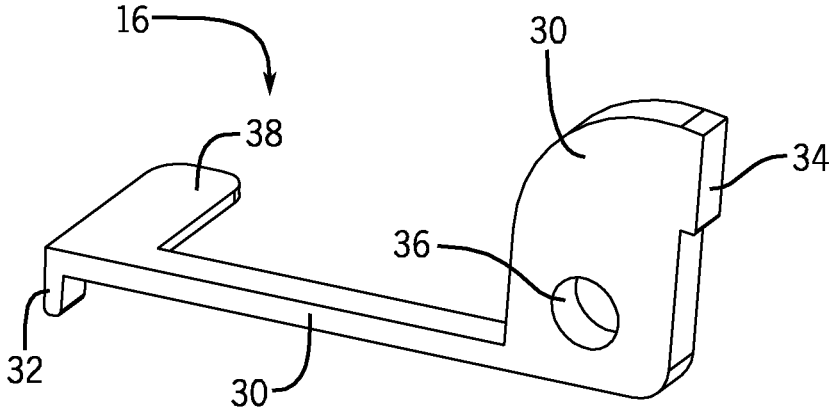
FIG. 7 is a perspective view of the blade lock of the knife assembly in accordance with an embodiment of the invention.

FIG. 7 illustrates the blade lock 16 which includes a lever arm 30, locking finger pin 32, spring face 34, pivot aperture 36 and actuation tab 38. The locking pin 32 engages in a blade notch 82 formed in the blade 14. A user may apply a force to the actuation tab 38 to rotate the lever arm 30 about pivot aperture 36. Spring 26 applies a force against spring face 34 to affectively rotate the locking pin 32 into the blade notch 82. The force applied to the actuation tab must be sufficient to overcome the compression spring 26.

Figure 8:
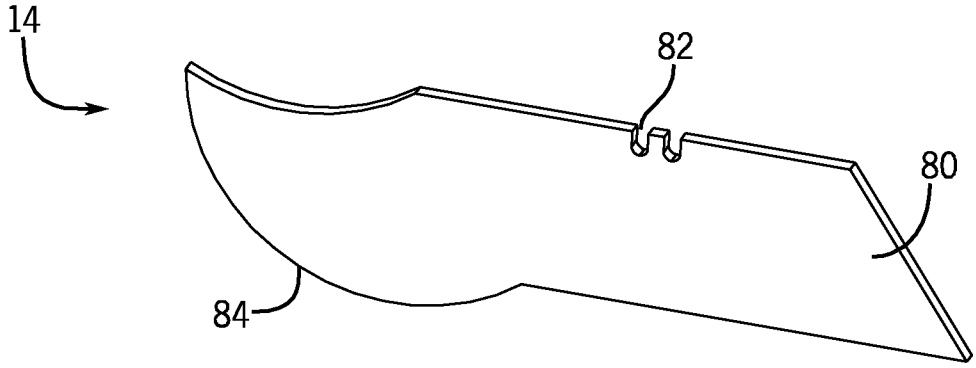
FIG. 8 is a perspective view of a blade insert of the knife assembly in accordance with an embodiment of the invention.
Figure 9:
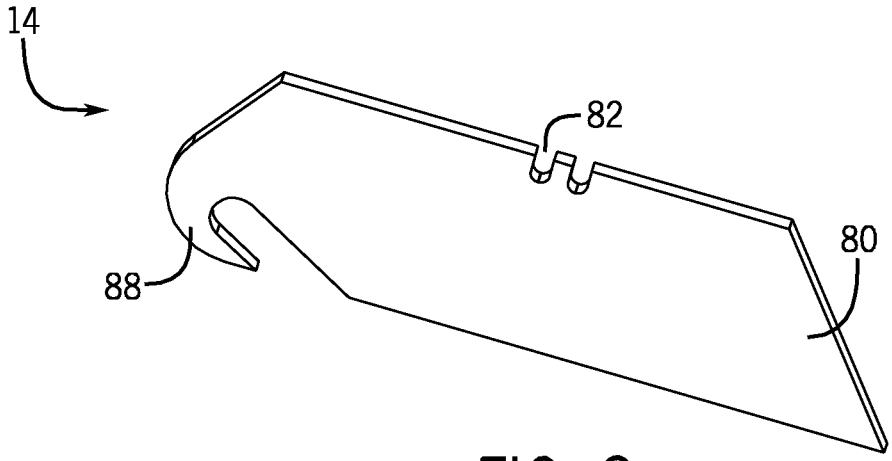
FIG. 9 is a perspective view of a blade insert of the knife assembly in accordance with an embodiment of the invention.
Figure 10:
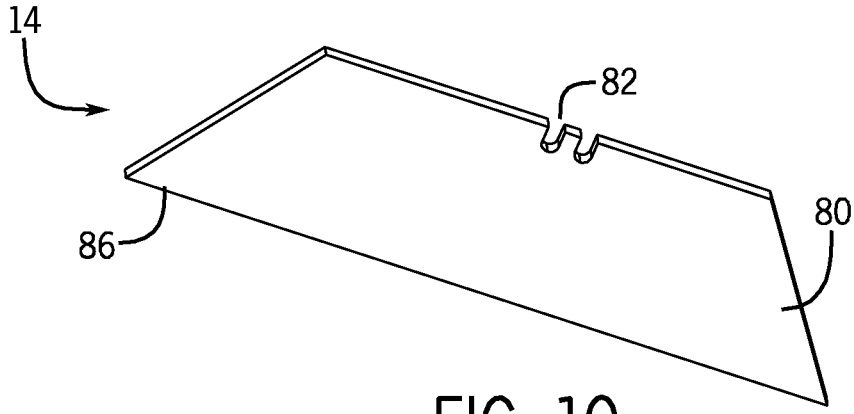
FIG. 10 is a perspective view of a blade insert of the knife assembly in accordance with an embodiment of the invention.

Without limitation intended, FIGS. 8-10 illustrate a variety of interchangeable blades 14 that may be inserted into the handle assembly 12. Generally a blade of suitable construction includes a blade body 80, a blade notch 82, and a cutting edge of the blade. FIG. 8 illustrates a curved cutting surface 84, FIG. 9 illustrates a straight cutting surface 86 and FIG. 10 illustrates a hooked cutting surface 88. The blade notch 82 is sized to engage with the locking pin 32 of the blade lock 14 or with the lock pin 32 as shown in FIG. 2.

Having described the constructional features of embodiments of the invention, the mode of use will next be described. A user selects a blade 14 having a desired cutting configuration and inserts it into blade pocket 44. The actuation tab 38 may be actuated upwards to reduce the amount of force required to insert the blade 14 into the pocket 44. Once the blade is inserted the user may release the tab so that the locking pin 32 engages with the blade notch 82. The user may then hold the handle 12 in the palm of the hand with or without inserting the fore and middle fingers into the finger holds 18 and 20. The user may select a blade 15 having an angle that allows for rocking the handle on the convex curvature or radius of the handle 12. By rocking the handle the blade 14 may move in and out of contact with the cutting surface. It has been found that a blade having a 25 degree angle allows for rocking the handle into engagement, but blades having other angles are equally well suited for cutting with the knife assembly of the present invention. When cutting with the blade, the user may press a portion of the convex curvature of the handle 12 against the cutting surface to assist in controlling the depth that the blade extends into the cutting surface. The user may store the cutting portion of the blade inside the handle 12 by removing the blade and inserting the cutting point into the blade pocket 44 until the blade notch 82 engages with the locking pin 32.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A knife assembly comprising:

a handle having first and second opposing rounded ends having a length between the ends, first and second sides, a palm receiving portion extending between the first and second ends and a blade receiving portion extending between the first and second ends, said blade receiving portion opposing the palm receiving portion and said blade receiving portion forming a convex curvature, the convex curvature defined by opposing endpoints of said convex curvature and said convex curvature having a radius less than the length between the ends and said convex curvature further having a blade pivot surface between said opposing endpoints and said first end and said second end, and said convex curvature extending away from the palm receiving portion;

at least two finger hold openings extending through said handle from the first side of said handle to the second side of said handle and between said ends and said palm receiving portion and said knife blade receiving portion;

an interchangeable blade extending outwardly from the convex curvature portion of the handle, between the opposing endpoints of said convex curvature and adjacent said blade pivot surface; and a blade lock engaged with said blade and said handle, said blade lock positioned adjacent said finger hold openings and includes an open position and locked position and is biased against the blade when in the locked position, said blade being accessible to unlock the blade through at least one of said finger hold openings.

2. The knife assembly as recited in claim 1 wherein the blade lock includes an actuation tab.

3. The knife assembly as recited in claim 1, wherein the palm receiving portion includes a concave surface formed in the palm receiving portion.

4. The knife assembly as recited in claim 1, wherein said handle further includes a blade support to reduce lateral movement of the interchangeable blade.

5. A knife assembly comprising:

a handle having a concave palm receiving portion and opposing convex blade receiving portion;

finger hold openings extending through said handle from a first side of said handle to a second side of said handle and extending between said concave palm receiving portion and said convex blade receiving portion;

a blade receiving pocket formed in said handle between endpoints of said convex blade receiving portion and terminating along an exterior portion of the convex blade receiving portion of said handle;

said convex blade receiving portion having a radius of curvature less than a length of the handle, said radius of curvature having a pivot point to contact a cutting surface away from a knife blade extending approximately perpendicular from said blade receiving pocket; and a blade lock at least a portion of which is aligned with said blade receiving pocket and aligned adjacent said finger hold openings, said blade being accessible from at least one of said finger hold openings to unlock the knife blade.

6. The knife assembly as recited in claim 5, wherein the blade lock includes an open position and locked position and is biased towards said blade receiving pocket when in the locked position.

7. The knife assembly as recited in claim 6 wherein the blade lock includes an actuation tab.

8. The knife assembly as recited in claim 5, wherein said blade receiving pocket includes a blade support to reduce lateral movement of an interchangeable blade within said blade receiving pocket.

9. A knife assembly comprising:

an approximately kidney shaped handle having a substantially planar first and second spaced apart sides, rounded ends, a concave palm receiving portion and opposing outwardly protruding convex blade receiving portion, wherein said convex portion has a radius of curvature that includes a blade pivot point along the radius of curvature;

said convex curvature having two opposing endpoints wherein blade pivot point is positioned between the two endpoints;

at least two isolated finger hold openings extending through said handle from said first side to said second side and between said concave palm receiving portion and said convex blade receiving portion to allow fingers to extend through the openings from said first side to said second side;

a blade receiving pocket adapted to receive an interchangeable knife blade, said blade receiving pocket formed in said handle between the two endpoints of said convex curvature and terminating along an exterior portion of the convex blade receiving portion of said handle; and a blade lock at least a portion of which is aligned adjacent said blade receiving pocket and positioned adjacent said finger hold openings, said blade lock further being accessible to unlock the knife blade from at least one of said finger hold openings.

10. The knife assembly as recited in claim 9, wherein the blade lock includes an open position and locked position and is biased towards said blade receiving pocket when in the locked position.

11. The knife assembly as recited in claim 10 wherein the blade lock includes an actuation tab.

12. The knife assembly as recited in claim 9, wherein said blade receiving pocket includes a blade support to reduce lateral movement of an interchangeable blade within said blade receiving pocket.

* * * * *